US009318075B2

(12) United States Patent
Kim et al.

(10) Patent No.: US 9,318,075 B2
(45) Date of Patent: Apr. 19, 2016

(54) IMAGE DRIVING USING COLOR-COMPENSATED IMAGE DATA THAT HAS BEEN COLOR-SCHEME CONVERTED

(71) Applicant: SAMSUNG DISPLAY CO., LTD., Yongin, Gyeonggi-do (KR)

(72) Inventors: Heen-Dol Kim, Yongin-si (KR); Jai-Hyun Koh, Seoul (KR); Ik-Soo Lee, Seoul (KR); Jin-Pil Kim, Suwon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 200 days.

(21) Appl. No.: 13/747,068

(22) Filed: Jan. 22, 2013

(65) Prior Publication Data

US 2014/0071174 A1 Mar. 13, 2014

(30) Foreign Application Priority Data

Sep. 11, 2012 (KR) ..... 10-2012-0100392

(51) Int. Cl.

| | |
|---|---|
| ***G09G 5/10*** | (2006.01) |
| ***G09G 3/20*** | (2006.01) |
| ***G09G 3/34*** | (2006.01) |
| ***G09G 3/36*** | (2006.01) |

(52) U.S. Cl.

CPC ..... *G09G 5/10* (2013.01); *G09G 3/2074* (2013.01); *G09G 3/3406* (2013.01); *G09G 3/364* (2013.01); *G09G 2300/0426* (2013.01); *G09G 2300/0443* (2013.01); *G09G 2300/0452* (2013.01); *G09G 2320/0242* (2013.01); *G09G 2320/0666* (2013.01)

(58) Field of Classification Search

CPC ..... G09G 3/36–3/3696; G09G 5/10; G09G 2300/0452; G09G 2320/0233; G09G 2320/0626–2320/0653; G09G 2340/06

USPC ..... 345/690–697

See application file for complete search history.

(56) References Cited

U.S. PATENT DOCUMENTS

| | | | | |
|---|---|---|---|---|
| 7,483,011 | B2 | 1/2009 | Yang et al. | |
| 8,013,867 | B2 | 9/2011 | Higgins et al. | |
| 2007/0279372 | A1 * | 12/2007 | Brown Elliott et al. | 345/102 |

(Continued)

FOREIGN PATENT DOCUMENTS

| | | |
|---|---|---|
| JP | 2009-192665 | 8/2009 |
| KR | 10-2010-0035906 | 4/2010 |
| WO | WO 2011036916 A1 * | 3/2011 |

OTHER PUBLICATIONS

English Abstract for Publication No. 2009-192665.

(Continued)

*Primary Examiner* — Nathan Danielsen

(74) *Attorney, Agent, or Firm* — F. Chau & Associates, LLC

(57) ABSTRACT

An image driving method includes receiving basic image data including a first set of primary colors. The basic image data is transformed into output image data including a second set of primary colors. Luminance values of the second set of primary colors of the output image data is reduced to compensate the luminance values of the second set of primary colors of the output image data when a luminance value of the first set of primary color of the basic image data is saturated. Image distortion is thereby minimized or prevented.

31 Claims, 10 Drawing Sheets

(56) References Cited

U.S. PATENT DOCUMENTS

2009/0102769 A1* 4/2009 Kouno et al. ..... 345/88
2009/0102864 A1* 4/2009 Fan-Chiang et al. ..... 345/690
2012/0249610 A1* 10/2012 Katagami et al. ..... 345/690

OTHER PUBLICATIONS

English Abstract for Publication No. 10-2010-0035906.

* cited by examiner

RGB COLOR DISTRIBUTION

IMAGE DRIVING USING COLOR-COMPENSATED IMAGE DATA THAT HAS BEEN COLOR-SCHEME CONVERTED

CROSS-REFERENCE TO RELATED APPLICATION

This application claims priority under 35 U.S.C. §119 to Korean Patent Application No. 10-2012-0100392, filed on Sep. 11, 2012, in the Korean Intellectual Property Office (KIPO), the contents of which are incorporated by reference herein in its entirety.

TECHNICAL FIELD

Example embodiments of the invention relate to a method and apparatus for image driving, and more particularly, to a method an apparatus for image driving capable of compensating color.

DISCUSSION OF THE RELATED ART

Conventional data used for displaying an image includes RGB data having red (R), green (G), and blue (B) data values. The RGB data may then be displayed on a display device that includes RGB pixels.

Because red, green, and blue are additive primary colors, a wide variety of colors may be reproduced based on red, green, and blue data values.

Some display devices utilize an RGB structure where each pixel includes exactly one red sub-pixel, one green sub-pixel, and one blue sub-pixel. Such displays may be capable of displaying RGB image data with acceptable luminance levels. However, some other display devices utilize an RGBW structure where each pixel includes a red sub-pixel, a green sub-pixel, a blue sub-pixel, and a white sub-pixel. Still other display devices utilize an RGBCY structure where each pixel includes a red sub-pixel, a green sub-pixel, a blue sub-pixel, a cyan sub-pixel, and a yellow sub-pixel. In fact, there is no limit to the number of different sub-pixel structures that a display device may utilize.

In displaying RGB image data on a non-RGB display device, the luminance with respect to certain reference colors may be distorted. This may be at least in part caused by the fact that in displaying RGB image data on a non-RGB display device, the number of sub-pixels required to generate a particular color may change. For example, it may take two sub-pixels to produce yellow on an RGB display device (red and green) but it may take only one sub-pixel (yellow) or it may take three sub-pixels (yellow, red, and green) to produce yellow on an RGBCY display device. Because colors may be displayed using various numbers of sub-pixels, the color that is reproduced from different display structures may show increased or decreased luminance for certain colors.

SUMMARY OF THE INVENTION

Exemplary embodiments of the present invention provide an image driving method capable of compensating for color luminance distortion.

Exemplary embodiments of the present invention also provide an image driving apparatus using the image driving method.

According to an exemplary embodiment of the present invention, an image driving method is provided as follows. Basic image data including a first set of primary colors is received. The basic image data is transformed into output image data including a second set of primary colors that is different from the first set of primary colors. Luminance values of the second set of primary colors of the output image data is reduced to compensate for increased luminance when a luminance value of the first set of primary colors of the basic image data is saturated.

In an exemplary embodiment, the first set of primary colors of the basic image data may include red (R), green (G), and blue (B) color values.

The second set of primary colors of the output image data may include a white (W) color.

In an exemplary embodiment, compensating the luminance values may include inspecting saturation status of each of the second set of primary colors of the output image data, determining a reduction ratio of the luminance value of the saturated color, and compensating the luminance values of the second set of primary colors of the output image data based on the determined reduction ratio.

In an exemplary embodiment, compensating the luminance values may further include delaying the compensating of the luminance values based on the determined reduction ratio.

In an exemplary embodiment, the saturated color of the second set of primary colors of the output image data may be a yellow color in the compensating the luminance values.

In an exemplary embodiment, the luminance value of the saturated yellow color of the output image data may be more than about 70% with respect to the luminance value of the saturated white color of the output image data in compensating the luminance values.

In an exemplary embodiment, compensating the luminance values based on the determined reduction ratio may include reducing all of the luminance values of the second set of primary colors of the output image data.

In an exemplary embodiment, the luminance values may be compensated based on the determined reduction ratio during a first period and a second period, and a first slope of the reduction ratio in the first period may be different from a second slope of the reduction ratio in the second period.

In an exemplary embodiment, the basic image data and the output image data may be compared to compensate a luminance of a backlight assembly that provides light to display the image.

In an exemplary embodiment, the backlight assembly may include a plurality of light sources independently driven at different luminances in different regions, and the luminance of the backlight assembly may be compensated independently in each region of the backlight assembly.

In an exemplary embodiment, the luminance of the backlight assembly may be compensated for by compensating luminance of a non-selected color of the backlight assembly, and compensating luminance of a selected color of the backlight assembly.

In an exemplary embodiment, the luminance of the backlight assembly may further be compensated for by calculating color distribution of the selected color of the second set of primary colors of the output image data, and comparing the color distribution of the selected color with a reference value to compensate the luminance of the non-selected color and to compensate the luminance of the selected color.

In an exemplary embodiment, the luminance of the non-selected color may be compensated by comparing a data luminance of the first set of primary colors of the basic image data with a data luminance of the second set of primary colors of the output image data in each of the regions of the backlight assembly, and independently driving luminance of the light sources in each of the regions of the backlight assembly.

In an exemplary embodiment, the data luminance of the first set of primary colors of the basic image data and the data luminance of the second set of primary colors of the output image data may be calculated based on pixel luminances of the first and second sets of primary colors and the number of pixels.

In an exemplary embodiment, the non-selected luminance may be compensated for by comparing a basic transmittance of the first set of primary colors of the basic image data with an output transmittance of the second set of primary colors of the output image data to compensate for the luminance of the backlight assembly.

In an exemplary embodiment, the luminance of the backlight assembly may be compensated for based on a luminance of a white color displayed by the first set of primary colors of the basic image data and a data luminance of a selected color of the output image data.

In an exemplary embodiment, the selected color may be a yellow color.

According to an exemplary embodiment of the invention, an image driving apparatus includes a color mapping part and a saturated color compensating part. The color mapping part receives basic image data having a first set of primary colors to change the basic image data into output image data having a second set of primary colors different from the first set. The saturated color compensating part decreases luminance values of the second set of primary colors of the output image data to compensate the luminance values of the second set of primary colors of the output image data when the basic image data of the first set of primary colors include a saturated color.

In an exemplary embodiment, the saturated color compensating part may include a saturated color searching part that searches a saturation state of each primary color of the second set of primary colors of the output image data, a reduction ratio determining part that determines a reduction ratio of luminance values of the second set of primary colors including the saturated color, and a color compensating part that compensates the luminance values of the second set of primary colors of the output image data based on the determined reduction ratio.

In an exemplary embodiment, the saturated color compensating part may further include a delaying part that delays the compensation of the color compensating part.

In an exemplary embodiment, the image driving apparatus may further include a backlight luminance compensating part that compares the basic image data with the output image data to compensate luminance of a backlight assembly.

In an exemplary embodiment, the backlight luminance compensating part may include a non-selected luminance compensating part that compensates luminance of a non-selected color of the backlight assembly, and a selected luminance compensating part that compensates luminance of a selected color of the backlight assembly.

In an exemplary embodiment, the backlight luminance compensating part may further include a selected color distribution calculating part that calculates a color distribution of the selected color of the second set of primary colors of the output image data, and a compensation method determining part comparing a color distribution of the selected color with a reference value to select one method of compensating the non-selected color by the non-selected luminance compensating part and compensating the selected color by the selected luminance compensating part.

When a color saturation of one color is high, the luminance of each of the primary colors is decreased by a particular ratio. Thus, the luminance of the saturated color is not decreased.

In particular, when a display apparatus includes a backlight, luminance of the backlight having the saturated color is compensated for to prevent distortion of the luminance during mapping of image data.

BRIEF DESCRIPTION OF THE DRAWINGS

The above and other aspects of exemplary embodiments of the present invention will become more apparent with reference to the following detailed description and the accompanying drawings, in which.

DETAILED DESCRIPTION OF EXEMPLARY EMBODIMENTS

Hereinafter, exemplary embodiments of the present invention will be explained in detail with reference to the accompanying drawings.

Figure 1:
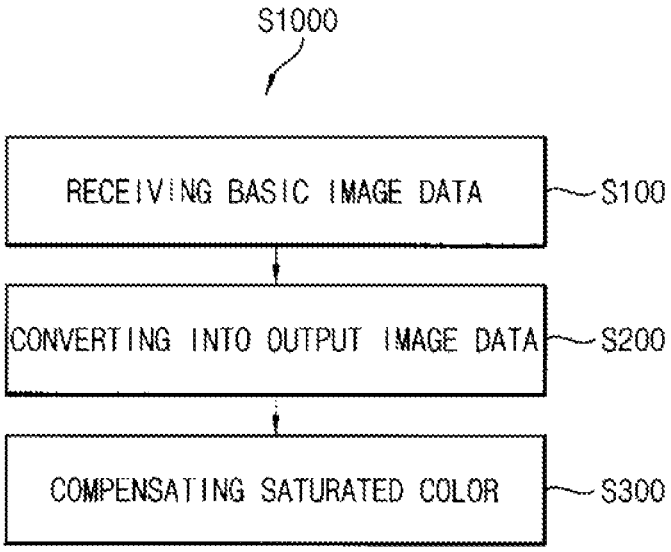
FIG. 1 is a flow chart illustrating an image driving method according to an exemplary embodiment of the present invention.

FIG. 1 is a flow chart illustrating an image driving method according to an exemplary embodiment of the present invention.

Referring to FIG. 1, according to the image driving method (step S1000), basic image data is received (step S100). The basic image data is converted into output image data (step S200). Saturated color is compensated for (step S300).

In the step S100 of receiving the basic image data, the basic image data including a first plurality of primary colors is received. As used herein, the phrase "primary color" may refer to any hue that may be combined with other hues, either additively or subtractive, to create a desired color. In this context, red, green, blue, yellow, white, cyan, magenta, black, etc. may all be considered primary colors. The basic image data is represented in terms of the first plurality of primary colors. For example, the basic image data may include three primary colors such as a red primary color, a green primary color, and a blue primary color (RGB).

Image data may be stored and transmitted through various methods. Also, outputted image may have various types. For example, the basic image data may be RGB type, and displayed output image may be RGBW type or RGBCY type. The RGBW type includes a red primary color, a green primary color, a blue primary color, and a white primary color. The RGBCY type includes a red primary color, a green primary color, a blue primary color, a cyan primary color, and a yellow primary color. Thus, the basic image data expressed in terms of the first plurality of primary colors is converted into being expressed in terms of a second plurality of primary colors. The first and second pluralities of primary colors may be different. However, there may be some overlap and the two pluralities of primary colors may differ by as few as one primary color that is present in one plurality but not the other.

Thus the kinds and numbers of the primary colors of the basic image data are different from those of the output image data. Therefore, color of the displayed image may be distorted.

In the step S300 of compensating the saturated color, errors of the output image data are compensated for. In the step S300, the errors of the output image data caused by the saturated colors are compensated for.

Figure 2:
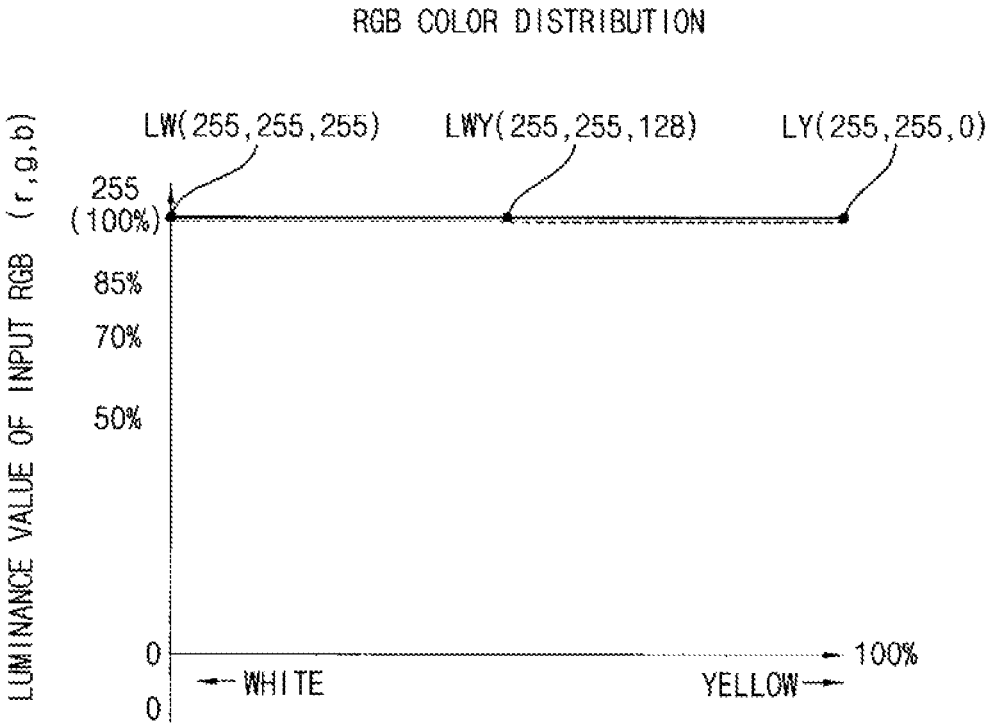
FIG. 2 is a graph illustrating a distribution of input data of FIG. 1.

FIG. 2 is a graph illustrating a distribution of input data of FIG. 1.

Referring to FIG. 2, the first primary colors of the input image data are the red (R), green (G), and blue (B), and the colors are distributed from a white point LW to a pure yellow point LY. Assuming color data for each color ranges from 0 to 255 (8-bits of data for each color), the white point LW has data of (255, 255, 255) with respect to the primary colors of the red (R), green (G), and blue (B). In the white point LW, the input data has the maximum values at all of the primary colors of the red (R), the green (G), and the blue (B). When the color is moved from the pure white point LW to the pure yellow point LY, blue data of the primary colors is decreased. Thus, the pure yellow point LY has the data of (255, 255, 0) with respect to the primary colors of the red (R), green (G), and blue (B). Also, a middle point LWY between the pure white point LW and the pure yellow point LY has the data of (255, 255, 128) with respect to the primary colors of the red (R), green (G), and blue (B).

Figure 3:
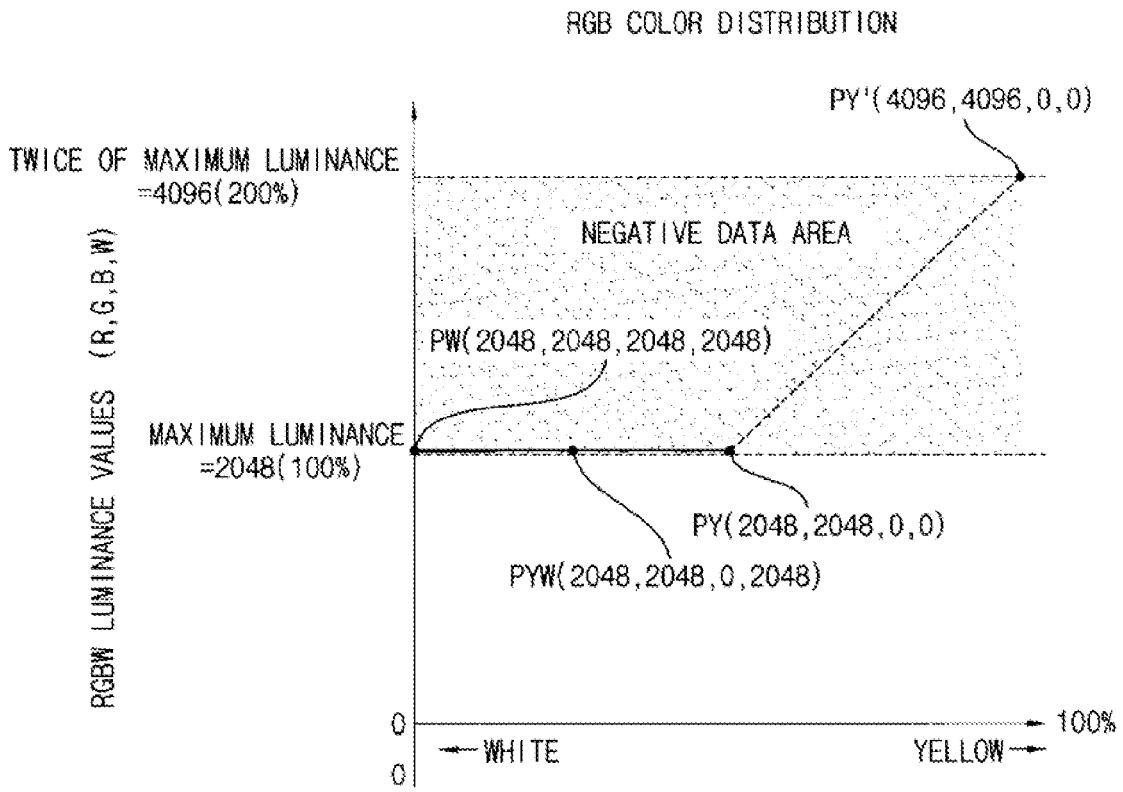
FIG. 3 is a graph illustrating a distribution of output data of FIG. 1.

FIG. 3 is a graph illustrating a distribution of output data of FIG. 1.

Referring to FIG. 3, the distribution of the output data is obtained by transforming the input data into the output data of the primary colors of red (R), green (G), blue (B), and white (W). The output data includes the primary colors of the red (R), green (G), blue (B), and white (W). Thus, a white image is displayed using the red (R), green (G), blue (B) and white (W) luminances and/or colored sub-pixels. In FIG. 2, the white point LW has data of (255, 255, 255) with respect to the primary colors of the red (R), green (G) and blue (B). However, in FIG. 3, the pure white point PW has data of (2048, 2048, 2048, 2048) with respect to the primary colors of the red (R), green (G), blue (B), and white (W). The number of 255 or 2048 represents maximum value of each color. Thus, the number representing the maximum value may be changed. The output data of the pure white point PW has maximum values at every color of the red (R), green (G), blue (B), and white (W). The luminance of the pure white point PW is twice that of the luminance of a white point having red (R), green (G), and blue (B) luminances without white (W) luminance.

The pure yellow point PY has data of (2048, 2048, 0, 0) with respect to the primary colors of the red (R), green (G), blue (B), and white (W). The pure yellow point PY is displayed by only the red (R) and green (G) colors, and white (W) is not illuminated. A middle point of a white-yellow point PWY between the pure white point PW and the pure yellow point PY has the data of (2048, 2048, 0, 2048) with respect to the primary colors of the red (R), green (G), blue (B), and white (W). The white-yellow point PWY corresponds to a mixture of a half of the pure white PW and a half of the pure yellow PY.

The pure yellow point PY represents pure yellow color in the output image data, and has the data of (2048, 2048, 0, 0). Thus, only red (R) and green (G) colors are illuminated at the pure yellow point PY. The white (W) color is not illuminated, so that the pure yellow point PY has a half luminance as compared with the pure white PW.

How image data is displayed may be determined by relative color data values. For example, in order to display an image of the white-yellow point PWY in a screen, the pure white point LW of the input image data has the same luminance as the pure yellow point LY of the input image data so that the pure white point PW of the output image data has the same luminance as the pure yellow point PY of the output image data. Thus, in order to display the image having the same luminance at the pure white point PW and the pure yellow point PY, the pure yellow point PY may be an imaginary pure yellow point. The imaginary pure yellow point has the data of (4096, 4096, 0, 0) with respect to the primary colors of the red (R), green (G), blue (B), and white (W). The maximum value displayed by each pixel is 2048. Thus, the values exceeding 2048 may not be displayed by the pixels of the display device so that the imaginary yellow point may not be displayable by the pixel. The non-displayable image is in a negative data area and may be considered "saturated." Thus, the output image data may be compensated to display the non-displayable image in the negative data area.

Figure 4:
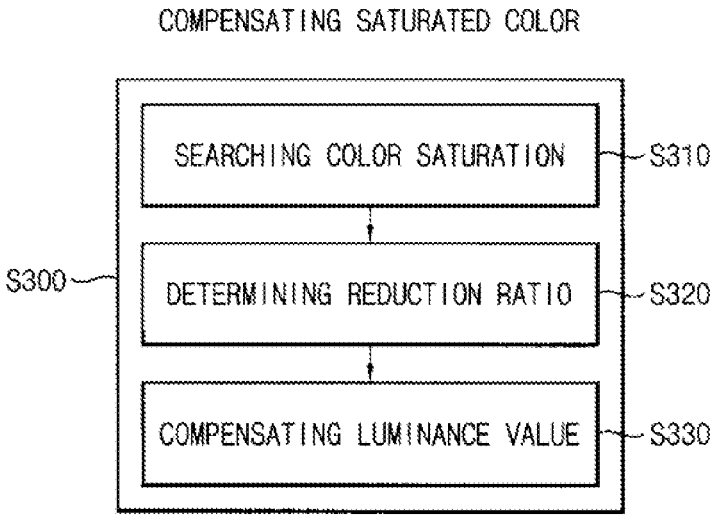
FIG. 4 is a flow chart illustrating a method of compensating saturated color in an image driving method according to an exemplary embodiment of the present invention.

FIG. 4 is a flow chart illustrating a method of compensating saturated color in an image driving method according to an exemplary embodiment of the present invention.

Referring to FIG. 4, according to the method (step S300) of compensating the saturated color in image driving, saturated color is searched for (step S310). A reduction ratio is determined (step S320). Luminance values are compensated (step S330). In the step S310 of searching for the saturated color, saturation of the second set of primary colors in the output image data is searched for. Saturation represents that at least some of the data of the second set of primary colors exceeds the maximum luminance value of each pixel. When the output data of the second set of primary colors is saturated, the output data includes the negative data corresponding to the non-displayable image. When the second set of primary colors includes the white color, the luminance of the white color is increased so that one of the non-white saturated second primary colors might not be displayed by the pixels. Thus, the output image data corresponding to the second primary colors may be compensated for and the image, including the negative data area, may be displayed. In the compensation of the output image data, luminance values of the second primary colors are reduced by a same reduction ratio so that the data in the negative data area is moved into a positive data area in which the image is displayable.

In the step S320 of determining the reduction ratio by which the luminance values of the saturated color is reduced, the reduction ratio for the second primary colors is determined. For example, the reduction ratio may be same in each color period. In the present embodiment, the reduction ratio may be different from each sub periods corresponding to different colors. Thus, the reduction ratio for the second primary colors may be determined by every sub period.

In the step S330 of compensating the luminance values, the luminance values of the second primary colors of the output image data is compensated by the reduction ratio. The luminance values of the second primary colors are decreased by the reduction ratio determined of step S320 of determining the reduction ratio.

Figure 5:
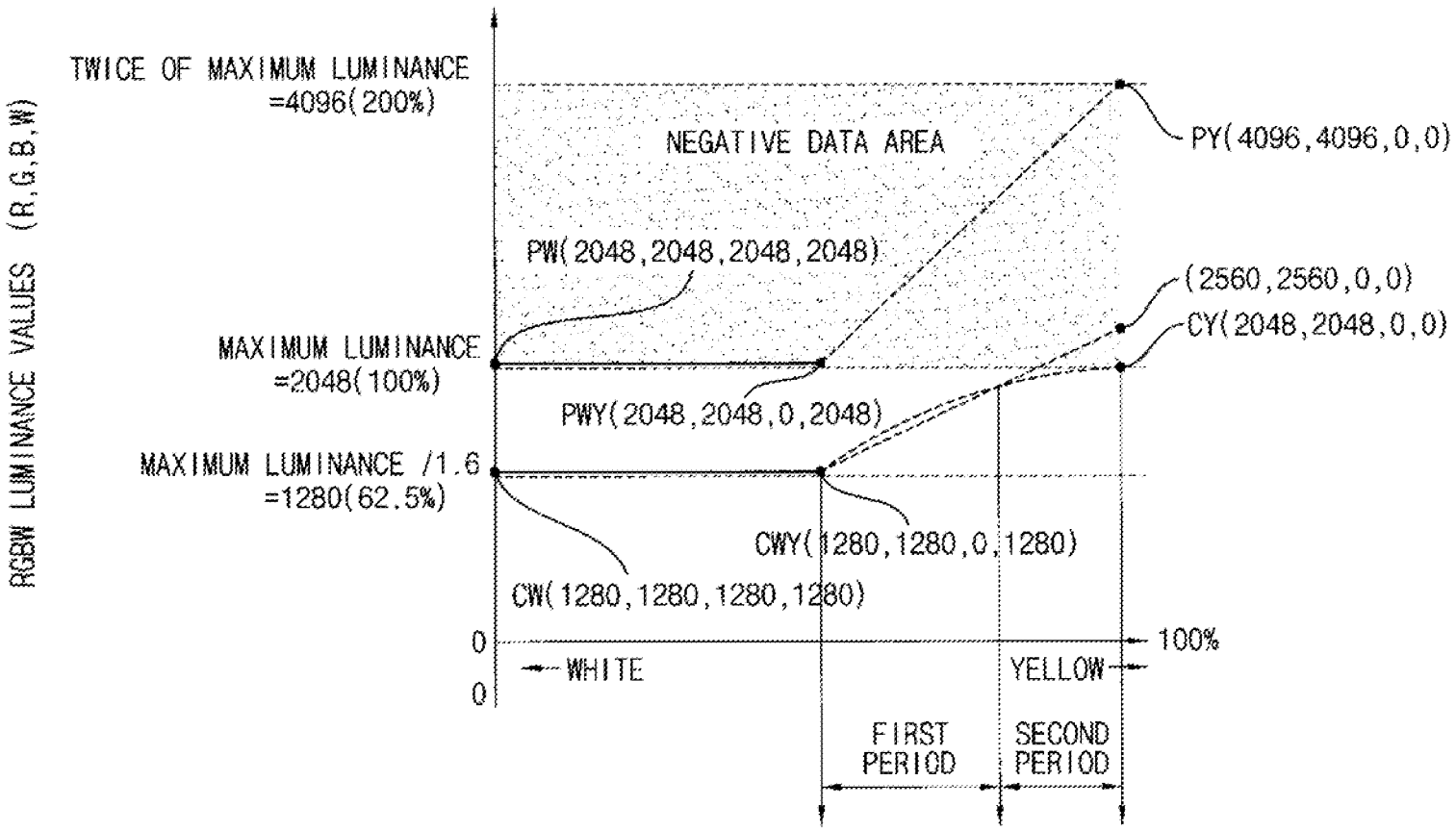
FIG. 5 is a graph illustrating a distribution of output data of FIG. 4.

FIG. 5 is a graph illustrating a distribution of output data of FIG. 4.

Referring to FIG. 5, the output image data compensated in step S330 of compensating the luminance values are illustrated. The output image data compensated in step S330 is compensated so that the luminance values of all of the primary colors are reduced by the reduction ratio. The luminance values of the second set of primary colors at the un-compensated pure white point PW are decreased to the compensated pure white point CW. The luminance values of the second set of primary colors at the un-compensated white-yellow point PWY are decreased to the compensated white-yellow point CWY.

The data at the compensated pure white point CW are (1280, 1280, 1280, 1280) with respect to the primary colors of the red (R), green (G), blue (B), and white (W). The data of the compensated pure white point CW are obtained by reducing the luminance values at the un-compensated pure white point PW by the reduction ratio of about 1.6 that is about 62.5% of the maximum luminance. Thus, a white image having the reduced luminance by about 62.5% is displayed at the compensated pure white point CW. Also, the same reduction method of the pure white point is applied to the white-yellow point. The data of the compensated white-yellow point CWY are obtained by reducing the luminance values at the un-compensated white-yellow point PWY by the reduction ratio of about 1.6 that is about 62.5% of the maximum luminance. Thus, the luminance values of the second set of primary colors between the pure white point PW and the white-yellow point PWY are decreased by about 62.5%. The luminance values are decreased for the second set of primary colors so that the colors of the displayed image are substantially the same and the luminances of the displayed image are decreased. For example, the reduction ratio may be about 70% or greater. When the reduction ratio is increased too much, luminance of the image may be greatly decreased. Thus, the reduction ratio may be optimized so that the luminance might not be greatly decreased.

The uncompensated pure yellow point PY is located in the negative data area so that the color corresponding to the uncompensated pure yellow point PY might not be displayed by the pixel. Thus, the uncompensated pure yellow point PY may be moved downwardly so that the compensated pure yellow point CY may be displayed by the pixel. The data at the compensated pure yellow point CY are (2048, 2048, 0, 0) with respect to the primary colors of the red (R), green (G), blue (B), and white (W). The luminance values of the compensated pure yellow point CY are maximum values of the yellow color that may be displayed by the pixel of a same display apparatus. When the pure white color and the pure yellow color are mixed in one image, the luminance of the yellow color is decreased but the purity of the yellow color is not changed.

The reduction ratio of the compensated pure yellow point CY may be different from the reduction ratio of the compensated white-yellow point CWY. For example, the luminance values for the second set of primary colors are reduced by the reduction ratio so that the reduction ratio of the compensated white-yellow point CWY is about 62.5%. The luminance values of the second set of primary colors at the compensated pure yellow point CY are substantially the same as the luminance values of the second set of primary colors at the uncompensated pure yellow point PY so that the reduction ratio at the compensated pure yellow point CY is about 100%. Thus, the reduction ratio may be gradually changed from 100% at the pure yellow point CY to about 62.5% at the white-yellow point CWY.

According to an exemplary embodiment, the area between the white-yellow point and the pure yellow point is divided into a first period and a second period. The reduction ratio for the second set of primary colors in the first period is different from the second period. The slope of the reduction ratio in the first period is different than in the second period. For example, the slope of the reduction ratio in the second period is gentler than the first period. When the slope of the first period is applied to the second period, an imaginary compensated pure yellow point CY1 may be located in the negative data area so that the image may not be displayed. Thus, the slope of the reduction ratio in the second period is gentler than the first period. For example, the slope of the reduction ratio in the first period is different from the slope of the reduction ratio in the second period. When the color is close to the pure yellow, color purity observed by human eyes is not changed. However, when the color is close to the white-yellow color, the color purity observed by the human eyes is easily changed so that the human eyes may easily recognize the change of the color purity. Thus, when the slope of the reduction ratio is increased, the human eyes may easily recognize the change of the color. The slopes of the reduction ratios in the first and second periods may be changed in various examples.

Figure 6A:
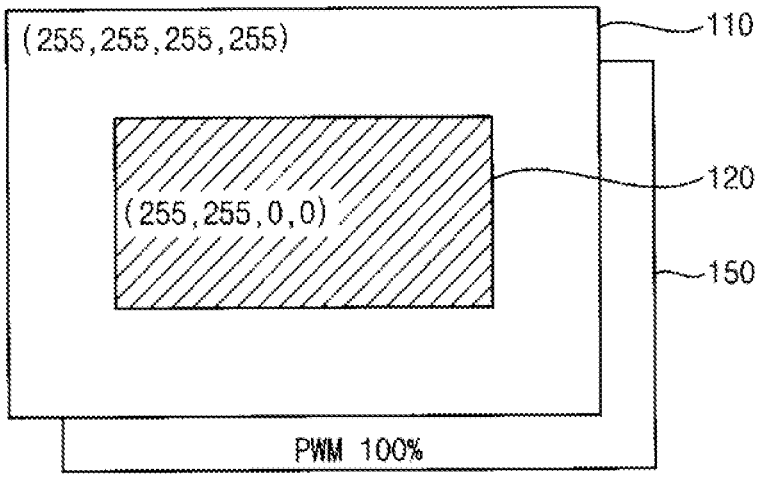
FIGS. 6A and 6B are plan views illustrating a screen displaying an uncompensated image and a screen displaying a compensated image compensated by the method shown in FIG. 4, respectively.
Figure 6B:
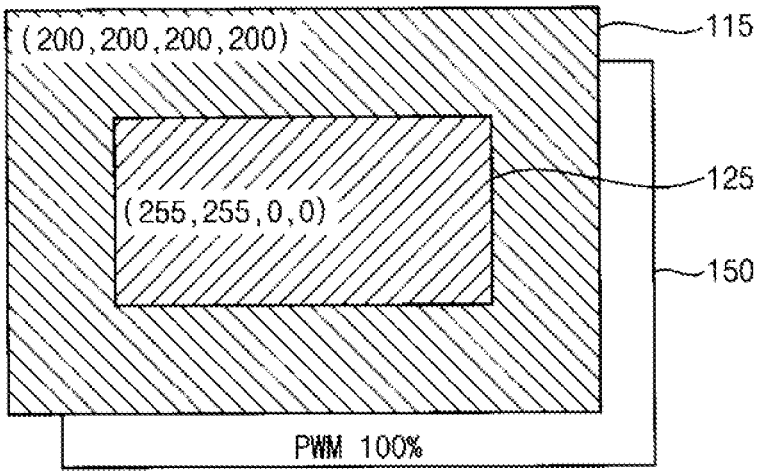

FIGS. 6A and 6B are plan views illustrating a screen displaying an uncompensated image and a screen displaying a compensated image compensated by the method of FIG. 4, respectively.

Referring to FIG. 6A, the screen displays a background image 110 of a white color and a central image 120 of a yellow color. A backlight assembly 150 supplies the screen with light having uniform luminance.

The background image 110 of the white color corresponds to the output image data having the second set of primary colors. The data of the background image of the white color is (255, 255, 255, 255) with respect to the primary colors of the red (R), green (G), blue (B), and white (W). Luminance of each color is represented by the luminance value from about 0 to about 255, and 255 corresponds to the maximum luminance.

The central image 120 of the yellow color corresponds to the output image data having the second set of primary colors. The data of the background image of the yellow color is (255, 255, 0, 0) with respect to the primary colors of red (R), green (G), blue (B), and white (W). The peripheral image 110 of the white color is displayed using the second set of primary colors of the red (R), green (G), and blue (B) as well as white (W). Thus, the luminance of the peripheral image 110 may be twice as high as the luminance of white image displayed using only the red (R), green (G), and blue (B) without white (W). However, the central image 120 of the yellow color is displayed using a portion of the second primary colors of only the red (R) and the green (G). Thus, the luminance of the central image 120 of the yellow color is about half the luminance of the background image 110 of the white color. Therefore, the luminance of the central image 120 of the yellow color is decreased with respect to the peripheral image 110 of the white color.

Referring to FIG. 6B, a compensated background image 115 of the compensated white color and a central image 125 of the yellow color are displayed on the screen of the display apparatus. The backlight assembly 150 supplies the screen with light having uniform luminance.

Referring again to FIGS. 6A and 6B, the compensated background image 115 of the white color is compensated. The data of the compensated background image 115 of the compensated white color is (200, 200, 200, 200) with respect to the second set of primary colors of red (R), green (G), blue (B), and white (W). The data of the compensated background image 115 of the compensated white color is reduced from the data of the background image 110 of the white color that is not compensated by the reduction ratio of about 78%. The color purity of the white color is not changed, but the luminance of the compensated background image 115 of the compensated white color is decreased. Thus, the luminance of the central image 125 of the yellow color of FIG. 6B seems brighter than the luminance of the central image 120 of the yellow color of FIG. 6A. Thus, the distortion caused during transformation of the input image data into the output image data may be compensated for.

Figure 7:
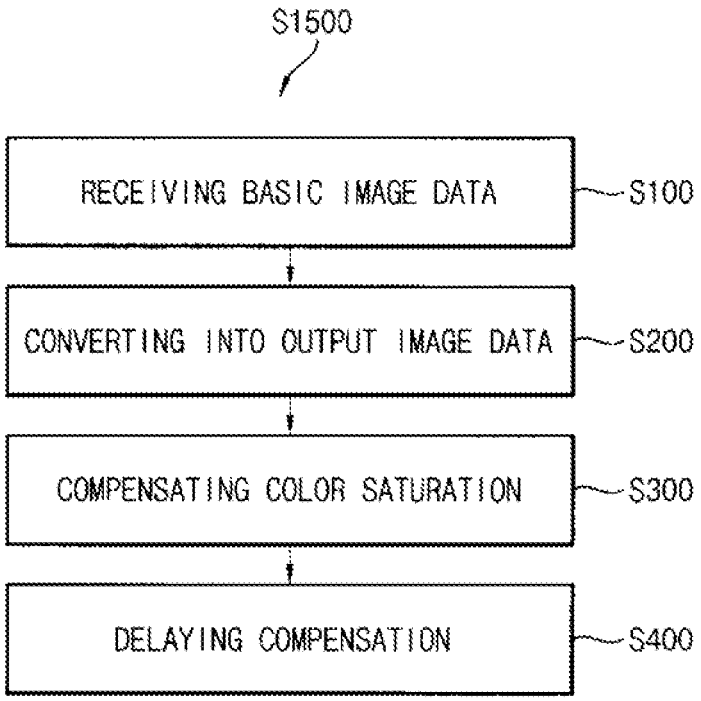
FIG. 7 is a flow chart illustrating an image driving method according to an exemplary embodiment of the present invention.

FIG. 7 is a flow chart illustrating an image driving method according to an exemplary embodiment of the present invention.

Referring to FIG. 7, according to the image driving method (step S1500), basic image data is received (step S100). The basic image data is converted into output image data (step S200). Saturated color is compensated (step S300). The compensation is delayed (step S400). Receiving the basic image data (step S100), converting the basic image data into the output image data (step S200), and compensating the saturated color (step S300) are substantially the same as in FIG. 1. Thus, any repetitive explanations concerning the above steps will be omitted.

In the step S400 of delaying the compensation, the compensation of the saturated color (step S300) is delayed. As used herein, the term "delayed" signifies that the implementation of the compensation throughout the image is gradually reduced over an area. When the saturated color of one of second primary colors is rapidly compensated, luminance of a background image or another portion of a screen is also rapidly decreased by saturation of one of the second primary colors so that the screen may be distorted by the rapid change of the luminance of the background image or the portion of the screen. However, when the compensation of the saturation (step S300) is delayed, the luminance of the background image or the portion of the screen is gradually decreased so that human eyes may not recognize the compensation process.

Figure 8:
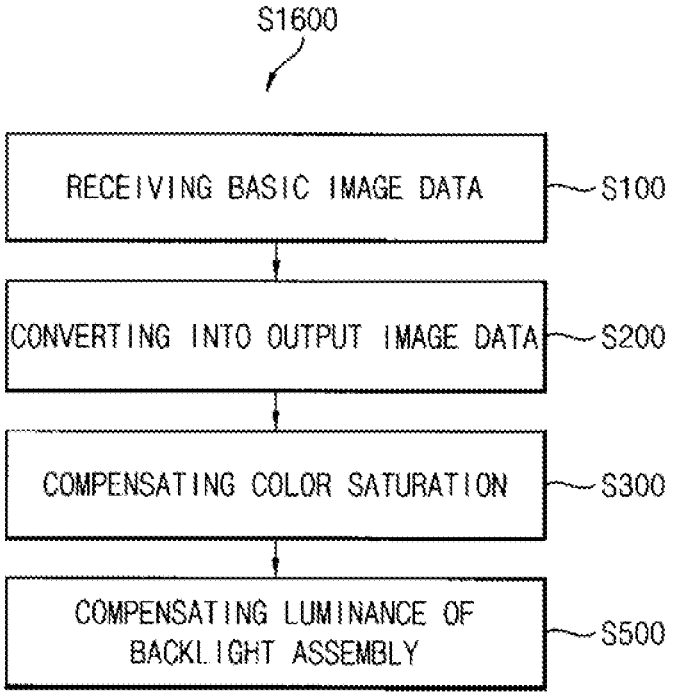
FIG. 8 is a flow chart illustrating an image driving method according to an exemplary embodiment of the present invention.

FIG. 8 is a flow chart illustrating an image driving method according to an exemplary embodiment of the present invention.

Referring to FIG. 8, according to the image driving method (step S1600), basic image data is received (step S100). The basic image data is converted into output image data (step S200). Saturated color is compensated (step S300). Luminance of a backlight assembly is compensated (step S500). Receiving the basic image data (step S100), converting the basic image data into the output image data (step S200) and compensating the saturated color (step S300) are substantially the same as in FIG. 1. Thus, any repetitive explanations concerning the above steps will be omitted.

In the step S500 of compensating the luminance of the backlight assembly, the basic image data is compared with the output image data to compensate the luminance of the backlight that may be used to display the output image data. The output image data is displayed using a display apparatus having the backlight assembly. Examples of the display apparatus having the backlight assembly may include a liquid crystal display (LCD) apparatus, an electro-wetting display apparatus, an electrophoretic display apparatus, etc.

The basic image data have different primary colors from the output image data, and also have different pixel structures. For example, the basic image data may have first set of primary colors of red (R), green (G), and blue (B), and the output image data may have second set of primary colors of red (R), green (G), blue (B), cyan (C), and yellow (Y). In addition, the basic image data may have a pixel structure including a red (R) pixel, a green (G), pixel and a blue (B) pixel, and the output image data may have a pixel structure including a red (R) pixel, a green (G) pixel, a blue (B) pixel, a cyan (C) pixel, and a yellow (Y) pixel. Thus, the number of pixels displaying an image is changed so that luminance may be also changed. Thus, the luminance of the backlight is compensated to compensate the luminance of the image that is changed by the compensation between the different primary colors and between different pixel structures.

Figure 9:
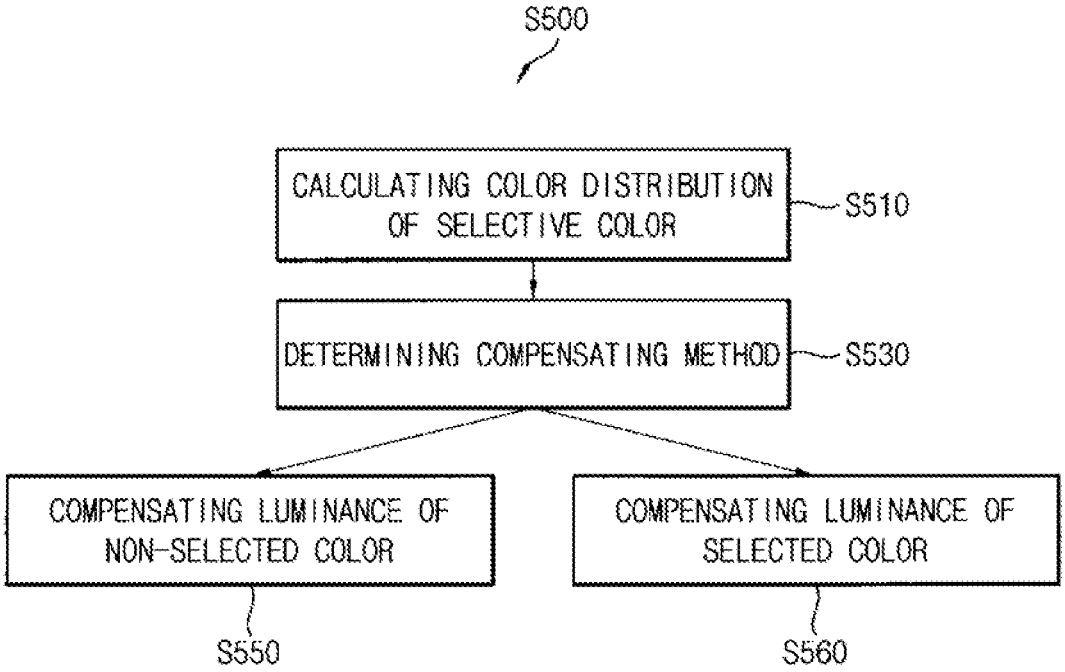
FIG. 9 is a flow chart illustrating an image driving method according to an exemplary embodiment of the present invention.

FIG. 9 is a flow chart illustrating an image driving method according to an exemplary embodiment of the present invention.

Referring to FIG. 9, in the step S500 of compensating the luminance of the backlight assembly, color distribution of a selected color that is selected from the second set of primary colors of the output image data is calculated (step S510). Compensation method is determined (step S530). For example, the step S500 of compensating the luminance of the backlight assembly may further include step of compensating luminance of non-selected color (step S550) and compensating luminance of the selected color (step S560).

In the step S510 of calculating the color distribution of the selected color, the color distribution of the selected color that is one of the second set of primary colors of the output image data. For example, a sensitive color that is sensitive to change of luminance is determined, and a color distribution of an image having a lot of the sensitive color is compared with a color distribution of an image having few of the sensitive color to calculate the color distribution of the sensitive color. The calculated values of the sensitive colors are compared to determine the color distribution of the selected color. In on example, the selected color may be yellow.

In the step S530 of determining the compensation method, the color distribution of the selected color is compared with a reference value to determine compensating method as either compensating the luminance of the non-selected color or compensating the luminance of the selected color.

Figure 10:
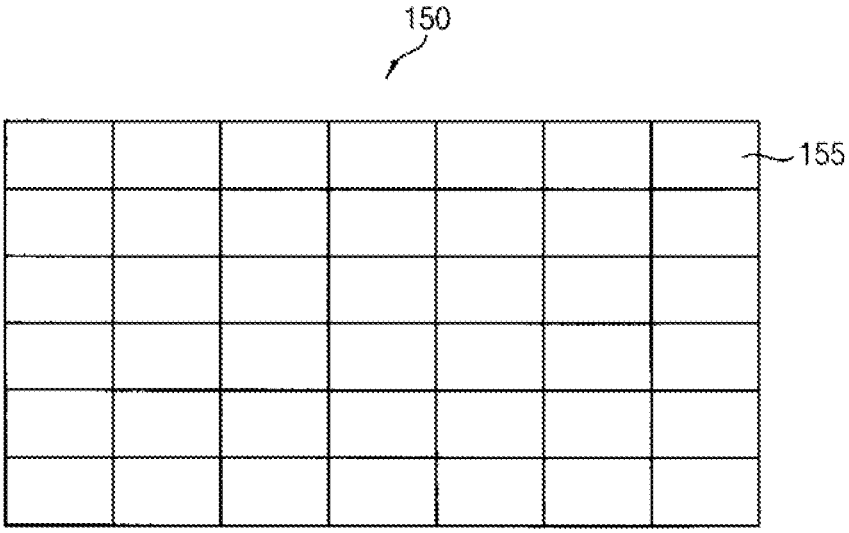
FIG. 10 is a plan view illustrating a backlight assembly using the image driving method of FIG. 9.

FIG. 10 is a plan view illustrating a backlight assembly using the image driving method of FIG. 9.

Referring to FIG. 10, the backlight assembly 150 includes a plurality of driving regions 155 when viewed on a plane.

The backlight assembly 150 is independently driven in each driving region 155 so that the luminance of each driving region 155 may be individually controlled. Thus, in the compensation of the luminance of the backlight assembly, the compensation value that may be the reduction ratio may be different from each other in each display region. Therefore, the luminance of the backlight assembly 150 may be independently compensated in each display region.

In the step S500 of compensating the luminance of the backlight assembly 150, an image is divided into the plurality of display regions, and luminance of light sources in each display regions is independently compensated based on the number of pixels in each display region of the basic image data and the number of pixels in the display region of the output image data.

Figure 11A:
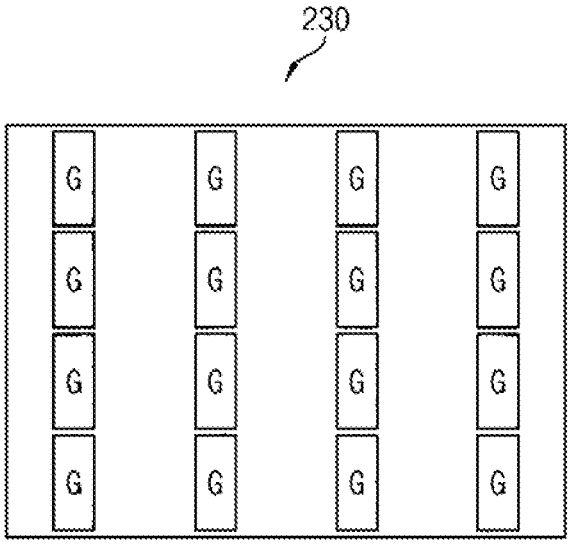
FIGS. 11A and 11B are plan views illustrating display pixels displaying images displayed by a method of compensating luminance of the backlight assembly in the image driving method of FIG. 10.
Figure 11B:
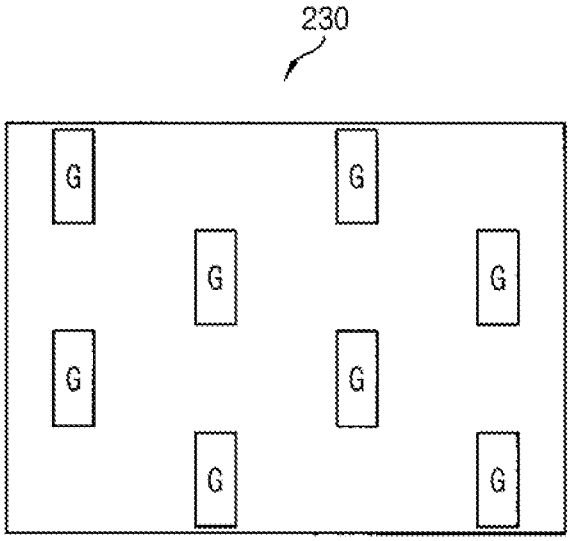

FIGS. 11A and 11B are plan views illustrating display pixels displaying images displayed in according with a method of compensating luminance of the backlight assembly in the image driving method of FIG. 10.

Referring to FIGS. 11A and 11B, the step S550 of compensating the luminance of the non-selected color will be explained. In the step S550 of compensating the luminance of the non-selected color, luminance data of the basic image data of the first set of primary colors is compared with luminance data of the output image data of the second set of primary colors in each driving region 155. Thus, luminance of light sources in each driving region 155 of the backlight assembly 150 is independently controlled.

Referring again to FIG. 11A, the number of pixel data of each red (R), green (G), and blue (B) color is substantially the same in each set of primary colors. Thus, in the pixel structure for the first set of primary colors of red (R), green (G), and blue (B), a column of the red (R) pixels, a column of the green (G) pixels, and a column of the blue (B) pixels may be alternately arranged. The number of green (G) pixels in a region shown in FIG. 11A may be about 16.

Referring again to FIG. 11B, the number of pixel data of red (R), green (G), blue (B), cyan (C) and yellow (Y) colors may be different from each color. For example, in the pixel structure for the second primary colors of the red (R), green (G), blue (B), cyan (C) and yellow (Y), a column of the red (R) pixels, a column of the green (G) pixels, a column of a mixture of the green (G) and yellow (Y) pixels, a column of the blue (B) pixels, a column of a mixture of the cyan (C) and the red (R) pixels, a column of a mixture of the green (G) and the yellow (Y) pixels and a column of the blue (B) pixels may be alternately arranged. The arrangement of the second set of primary colors may be changed. Thus, when the primary colors are changed, the arrangement of the pixels is also changed so that the number of the pixels is changed. For example, the number of the green (G) pixels of FIG. 11B is about a half of the green (G) pixels of FIG. 11A. Thus, the luminance of the green (G) pixels of FIG. 11B viewed by human eyes may be about a half of the luminance of the green (G) pixels of FIG. 11A. Although the same color is used to display an image, the luminance may be decreased by about a half so that the color of the output image may be different from the color of the basic image.

In order to compensate for the decrease of the luminance, the luminance of the backlight assembly is controlled. In FIGS. 11A and 11B, the number of the green (G) pixels is decreased by about a half so that the luminance in the driving region 155 is increased by about twice.

Therefore, in the step S550 of compensating the data luminance of the non-selected color, the data luminance of the basic image data of the first set of primary colors and the data luminance of the output image data of the second set of primary colors are compensated based on the luminance value of each pixel of the first and second primary colors and the number of the pixels of the first and second primary colors.

According to an exemplary embodiment, the method of compensating the luminance of the backlight assembly may further include a step of comparing a basic transmittance of the first set of primary colors of the basic image data with an output transmittance of the second set of primary colors of the output image to compensate the luminance of the backlight assembly based on transmittance of the color lights. For example, the transmittance of the image using the second set of primary colors RGBCY is greater than the transmittance of the image using the first set of primary colors RGB by about 15%. Thus, the luminance of the backlight assembly may be compensated based on the transmittance.

Figure 12A:
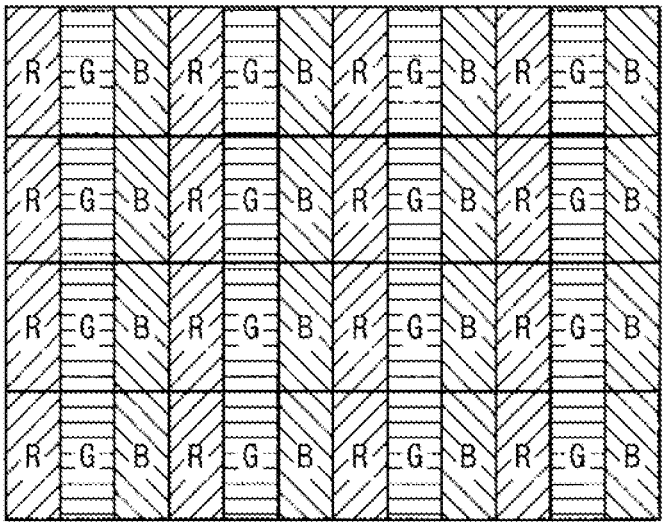
FIGS. 12A and 12B are plan views illustrating display pixels displaying images displayed by a method of compensating luminance of the backlight assembly in the image driving method of FIG. 10.
Figure 12B:
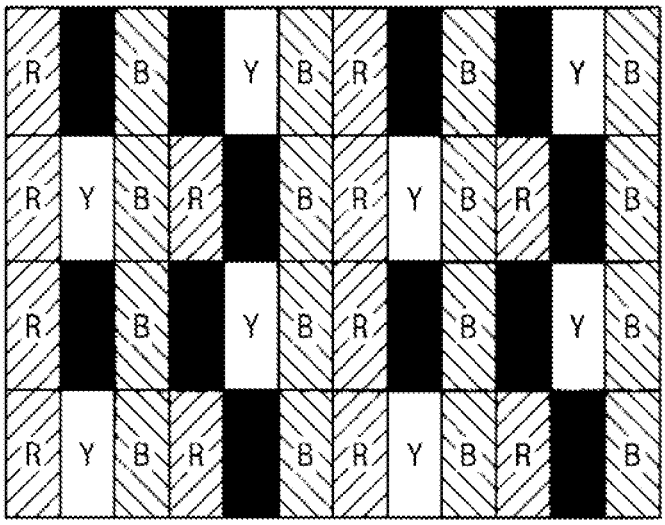

FIGS. 12A and 12B are plan views illustrating display pixels displaying images din accordance with a method of compensating luminance of the backlight assembly in the image driving method as shown in FIG. 10.

Referring to FIG. 12A, the number of pixels of the selected color (e.g. the yellow color) is relatively high as compared with other the colors. In the RGB pixel structure, the yellow color is generated by mixing the red (R) and the green (G). For example, all of the red (R) pixels and the green (G) pixels except the blue (B) pixels are driven to display the yellow color. Thus, only yellow color is displayed on the screen. When the primary colors are changed, the pixel distribution may be changed.

Referring to FIG. 12B, in the RGBCY pixel structure, the yellow color is generated by mixing the red (R), the yellow (Y) and the blue (B). The green (G) pixels and the cyan (C) pixels are not driven. Thus, the number and distribution of the pixels of FIG. 12B are different from the pixels of FIG. 12A. Here, the selected color (e.g. yellow) is produced by a relatively large number of pixels so that the luminance of the backlight assembly is compensated with reference to the abundance of the yellow color.

In the step S560 of compensating the luminance of the selected color, the luminance of the backlight assembly is compensated based on the luminance of the white color displayed by the first set of primary colors of the basic image data and the data luminance of the selected color of the output image data. For example, the selected color may be the yellow color.

When the luminance of the image is decreased, the yellow color may seem darker than a background image surrounding the yellow image. This effect may be referred to as "simultaneous contrast." Thus, a selective compensation is used to correct the yellow color.

Figure 13:
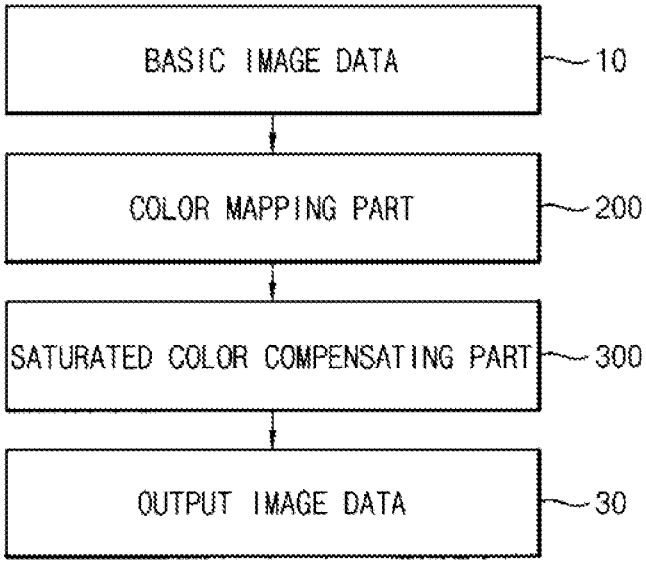
FIG. 13 is a block diagram illustrating an image driving apparatus according to an exemplary embodiment of the present invention.

FIG. 13 is a block diagram illustrating an image driving apparatus according to an exemplary embodiment of the present invention.

Referring to FIG. 13, the image driving apparatus includes a color mapping part 200 and a saturated color compensating part 300. The color mapping part 200 receives basic image data 10 to generate output image data. The basic image data is represented with a color scheme including a first plurality of primary colors. The output image data is represented with a color scheme including a second plurality of primary colors. The second plurality of primary colors of the output image data are different from the first plurality of primary colors of the basic image data by at least one color. Luminance of an image displayed using the second plurality of primary colors may be different from the luminance of an image displayed using the first plurality of primary colors. Thus, compensation is provided. The saturated color compensating part 300 compensated the generated output image data. In particular, when the first plurality of primary colors of the basic image data include a saturated color, the luminance of the second plurality of primary colors of the output image data is reduced. Thus, final output image data 300 is generated.

Figure 14:
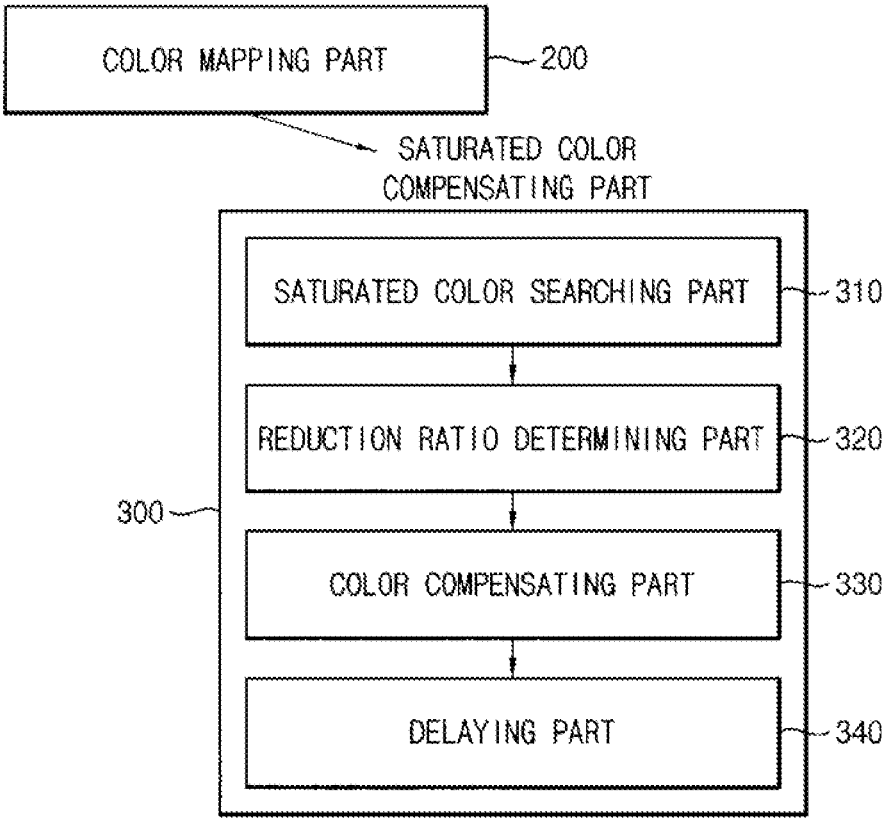
FIG. 14 is a block diagram illustrating an image driving apparatus according to an exemplary embodiment of the present invention.

FIG. 14 is a block diagram illustrating an image driving apparatus according to an exemplary embodiment of the present invention.

Referring to FIG. 14, the image driving apparatus includes a color mapping part 200 and a saturation color compensating part 300. The saturation color compensating part 300 includes a saturated color searching part 310, a reduction ratio determining part 320 and a color compensating part 330. The saturation color compensating part 300 may further include a delay part 340. The saturated color searching part 310 searches saturation state of each color of the second plurality of primary colors in the output image data. For example, the saturation color searching part 310 may analyze a saturation state of a yellow color of the second plurality of primary colors. The reduction ratio determining part 320 determines a reduction ratio of a luminance value of the saturated color. The reduction ratio may have different values in every color regions. The reduction ratio determining part searches distribution of color and luminance of each of the second plurality of primary colors to determine the reduction ratio. The color compensating part 330 compensates the luminance values of the second plurality of primary colors of the output image data.

The delaying part 400 delays the compensation of the color compensating part 330 so that the color compensating part 330 slowly compensates. Thus, users may not recognize the compensation so that the image may be gradually changed into the compensated image.

Figure 15:
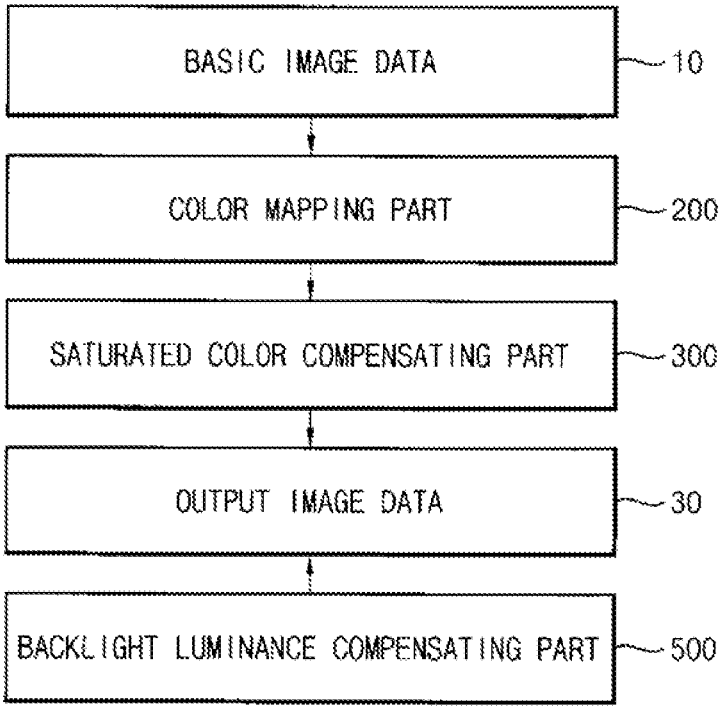
FIG. 15 is a block diagram illustrating an image driving apparatus according to an exemplary embodiment of the present invention.

FIG. 15 is a block diagram illustrating an image driving apparatus according to an exemplary embodiment of the present invention.

Referring to FIG. 15, the image driving apparatus includes a color mapping part 200, a saturation color compensating part 300 and a backlight luminance compensating part 500. The color mapping part 200 and the saturation color compensating part 300 are substantially the same as shown in FIG. 13. Thus, any repetitive explanations concerning the above elements will be omitted. The color mapping part 200 receives basic image data 10. The backlight luminance compensating part 500 compares the basic image data 10 with the output image data 30 to compensate luminance of a backlight assembly.

When the image driving apparatus uses an external light, the external light may be compensated again so that users may see more natural image. Examples of the image driving apparatuses that may use the external light may include a liquid crystal display (LCD) device, an electro-wetting display device, an electrophoretic display device, etc. The backlight luminance compensating part 500 divides the backlight assembly into a plurality of divided regions so that the divided regions may be independently operated.

Figure 16:
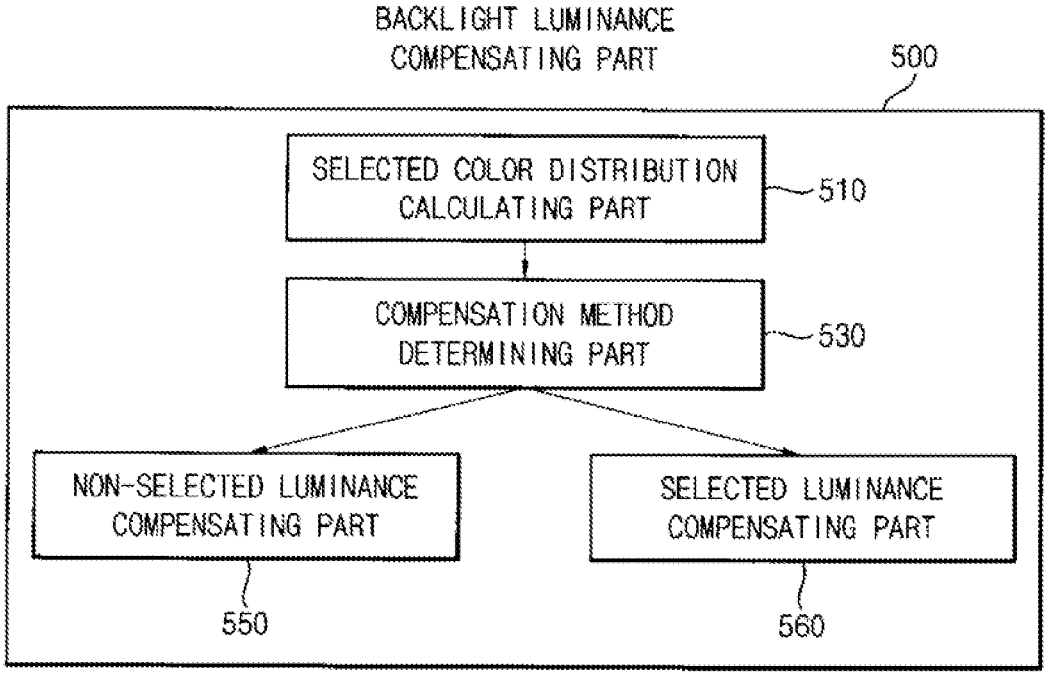
FIG. 16 is a block diagram illustrating an image driving apparatus according to an exemplary embodiment of the present invention.

FIG. 16 is a block diagram illustrating an image driving apparatus according to an exemplary embodiment of the present invention.

Referring to FIG. 16, the backlight luminance compensation part 500 includes a selected color distribution calculating part 510 and a compensation method determining part 530. The backlight luminance compensating part 500 may further include a non-selected luminance compensating part 550 and a selected luminance compensating part 560.

The selected color distribution calculating part 510 calculates color distribution of a selected color of the second plurality of primary colors of the output image data. For example, the color distribution calculating part 510 may calculate color distribution of a yellow color that is sensitive to simultaneous contrast. The compensation method determining part 530 compares the color distribution of the selected color with a reference value to select one of a step of compensating luminance of the non-selected luminance and a step of compensating luminance of a selected color. The selected color may be, for example, yellow. When the color distribution of the yellow color is smaller than the reference value, the non-selected luminance compensating part 550 compensates the luminance values of the output image data. However, when the color distribution of the yellow color is greater than the reference value, the selected luminance compensating part 560 compensates the luminance values of the output image data.

Accordingly, when the color saturation of the selected color is high, luminance values of the primary colors are reduced by the reduction ratio. Thus, relative luminance of the saturated color is not decreased.

In particular, when the display device includes the backlight assembly, the luminance of the backlight assembly is compensated so that luminance distortion may not be displayed by image data mapping.

The foregoing is illustrative of the invention and is not to be construed as limiting thereof. Although exemplary embodiments of the invention have been described, those skilled in the art will readily appreciate that many modifications are possible without materially departing from the invention.

What is claimed is:

1. An image driving method comprising:

receiving first image data represented in accordance with a first color scheme including a first plurality of primary colors;

transforming the first image data into a second image data represented in accordance with a second color scheme including a second plurality of primary colors, the second plurality of primary colors being different than the first plurality of primary colors by at least one additional color; and reducing luminance values of one or more of the second plurality of primary colors of the second image data to compensate for saturation in the second image data by multiplying at least one common reduction ratio, which varies depending on a luminance value of the additional color, to the luminance values of each of the second plurality of primary colors of the second image data.

2. The image driving method of claim 1, wherein the first plurality of primary colors of the first image data comprise red (R), green (G) and blue (B) colors.

3. The image driving method of claim 1, wherein the second plurality of primary colors of the second image data comprise a white (W) color.

4. The image driving method of claim 1, wherein compensating the luminance values comprises:

inspecting saturation status of each of the second plurality of primary colors of the second image data;

determining a reduction ratio of the luminance value of one or more saturated colors; and compensating the luminance values of the second plurality of primary colors of the second image data based on the determined reduction ratio.

5. The image driving method of claim 4, wherein compensating the luminance values further comprises delaying the compensating of the luminance values of the second plurality of primary colors.

6. The image driving method of claim 5, wherein the saturation in the second image data includes saturation of a yellow color.

7. The image driving method of claim 6, wherein the luminance value of the saturated yellow color of the second image data is about 70% or greater than the luminance value of a saturated white color of the second image data in the compensating of the luminance values.

8. The image driving method of claim 4, wherein compensating the luminance values based on the determined reduction ratio comprises reducing each of the luminance values of the second plurality of primary colors of the second image data.

9. The image driving method of claim 4, wherein the luminance values of the second plurality of primary colors are compensated based on the determined reduction ratio during a first period and a second period, and a first slope of the reduction ratio in the first period is different from a second slope of the reduction ratio in the second period.

10. The image driving method of claim 1, further comprising comparing the first image data and the second image data to compensate a luminance of a backlight assembly that provides light to a display device to display the second image data.

11. The image driving method of claim 10, wherein the backlight assembly comprises a plurality of light sources independently driven at different luminances in different regions, and the luminance of the backlight assembly is compensated in each region of the backlight assembly.

12. The image driving method of claim 11, wherein compensating the luminance of the backlight assembly comprises:

compensating luminance of a non-selected color of the backlight assembly; and compensating luminance of a selected color of the backlight assembly.

13. The image driving method of claim 12, wherein compensating the luminance of the backlight assembly further comprises:

calculating color distribution of the selected color of the second plurality of primary colors of the second image data; and comparing the color distribution of the selected color with a reference value and compensating the luminance of the non-selected color or compensating the luminance of the selected color based in the comparison.

14. The image driving method of claim 12, wherein compensating the luminance of the non-selected color comprises:

comparing a data luminance of the first plurality of primary colors of the first image data with a data luminance of the second plurality of primary colors of the second image data in each of the regions of the backlight assembly; and independently driving luminance of the light sources in each of the regions of the backlight assembly.

15. The image driving method of claim 14, wherein the data luminance of the first plurality of primary colors of the first image data and the data luminance of the second plurality of primary colors of the second image data are calculated based on pixel luminances of the first and second pluralities of primary colors and the number of pixels.

16. The image driving method of claim 15, wherein compensating the non-selected luminance comprises comparing a first transmittance of the first plurality of primary colors of the first image data with output second transmittance of the second plurality of primary colors of the second image data to compensate the luminance of the backlight assembly.

17. The image driving method of claim 12, wherein the luminance of the backlight assembly is compensated based on a luminance of a white color displayed by the first plurality of primary colors of the first image data and a data luminance of a selected color of the second image data.

18. The image driving method of claim 17, wherein the selected color is a yellow color.

19. The image driving method of claim 1, wherein the at least one common reduction ratio is a plurality of reduction ratios and the plurality of common reduction ratios are applied to the luminance values of each of the second plurality of primary colors of the second image data such that a first reduction ratio, of the plurality of common reduction ratios, for compensating for a pure yellow point is different from a second reduction ratio, of the plurality of common reduction ratios, for compensating for a white-yellow point.

20. The image driving method of claim 1, wherein the at least one common reduction ratio gradually increases as a luminance value of the additional color is reduced.

21. An image driving apparatus comprising:

a color mapping part receiving a first image data represented in accordance with a first color scheme including a first plurality of primary colors and changing the first image data into second image data represented in accordance with a second color scheme including a second plurality of primary colors different than the first plurality of colors by at least one additional color; and a saturated color compensating part decreasing luminance values of the second plurality of primary colors of the second image data and compensating for the luminance values of the second plurality of primary colors of the second image data when the first image data of the first plurality of primary colors include a saturated color by multiplying at least one common reduction ratio, which varies depending on a luminance value of the additional color, to the luminance values of each of the second plurality of primary colors of the second image data.

22. The image driving apparatus of claim 21, wherein the saturated color compensating part comprises:

a saturated color searching part that searches a saturation state of each of the second plurality of primary colors of the second image data;

a reduction ratio determining part that determines a reduction ratio of luminance values of the second plurality of primary colors including the saturated color; and a color compensating part that compensates the luminance values of the second plurality of primary colors of the second image data based on the determined reduction ratio.

23. The image driving apparatus of claim 22, wherein the saturated color compensating part further comprises a delaying part that delays the compensation of the color compensating part.

24. The image driving apparatus of claim 21, further comprising a backlight luminance compensating part that compares the first image data with the second image data to compensate luminance of a backlight assembly.

25. The image driving apparatus of claim 24, wherein the backlight luminance compensating part comprises:

a non-selected luminance compensating part that compensates luminance of a non-selected color of the backlight assembly; and a selected luminance compensating part that compensates luminance of a selected color of the backlight assembly.

26. The image driving apparatus of claim 25, wherein the backlight luminance compensating part further comprises:

a selected color distribution calculating part that calculates a color distribution of the selected color of the second plurality of primary colors of the second image data; and a compensation method determining part comparing a color distribution of the selected color with a reference value to compensate the non-selected color by the non-selected luminance compensating part or to compensate the selected color by the selected luminance compensating part based on the comparison.

27. The image driving apparatus of claim 21, wherein the at least one common reduction ratio is a plurality of reduction ratios and the plurality of common reduction ratios are applied to the luminance values of each of the second plurality of primary colors of the second image data such that a first reduction ratio, of the plurality of common reduction ratios, for compensating for a pure yellow point is different from a second reduction ratio, of the plurality of common reduction ratios, for compensating for a white-yellow point.

28. The image driving apparatus of claim 21, wherein the at least one common reduction ratio gradually increases as a luminance value of the additional color is reduced.

29. A method of displaying an image, comprising:

receiving a first image represented as a set of pixels, each pixel expressed as luminance value of each of a first plurality of colors;

transforming the first image into a second image represented as a set of pixels, each pixel expressed as a luminance value of each of a second plurality of colors, the second plurality of colors being different than the first plurality of colors by at least one additional color;

compensating for saturation in the second image by multiplying a compensation ratio to the luminance values of one or more of the colors of the second plurality of colors of the second image or by selectively driving sections of a backlight device by multiplying at least one common reduction ratio, which varies depending on a luminance value of the additional color, to the luminance values of each of the second plurality of primary colors of the second image data; and displaying the compensated image on a display device including the backlight device.

30. The method of claim 29, wherein the at least one common reduction ratio is a plurality of reduction ratios and the plurality of common reduction ratios are applied to the luminance values of each of the second plurality of primary colors of the second image data such that a first reduction ratio, of the plurality of common reduction ratios, for compensating for a pure yellow point is different from a second reduction ratio, of the plurality of common reduction ratios, for compensating for a white-yellow point.

31. The method of claim 29, wherein the at least one common reduction ratio gradually increases as a luminance value of the additional color is reduced.

* * * * *